United States Patent [19]

Britz

[11] 4,040,769

[45] Aug. 9, 1977

[54] FAN WHEEL

[76] Inventor: Robert N. Britz, 105 Murphy Lake Road, Park Ridge, Ill. 60068

[21] Appl. No.: 659,790

[22] Filed: Feb. 20, 1976

[51] Int. Cl.[2] ..... F04D 29/34

[52] U.S. Cl. ..... 416/213 A; 416/215; 416/244 R

[58] Field of Search ..... 416/244, 245, 213 A, 416/DIG. 3, 215, 216, 214, 220 A

[56] References Cited

U.S. PATENT DOCUMENTS

| | | | |
|---|---|---|---|
| 22,373 | 12/1858 | Montgomery | 416/245 A |
| 1,835,913 | 12/1931 | Squires | 416/213 A |
| 2,079,473 | 5/1937 | Wade | 416/213 X |
| 2,524,870 | 10/1950 | Adamtchik | 416/245 |
| 2,974,728 | 3/1961 | Culp | 416/DIG. 3 |
| 3,002,266 | 10/1961 | Lynn et al. | 416/212 X |
| 3,609,841 | 10/1971 | Telfer et al. | 416/213 X |

FOREIGN PATENT DOCUMENTS

| | | | |
|---|---|---|---|
| 997,656 | 1/1952 | France | 416/213 A |
| 897,749 | 11/1953 | Germany | 416/213 A |
| 2,322,599 | 11/1973 | Germany | 416/213 |
| 400,096 | 11/1942 | Italy | 416/213 A |
| 238,024 | 9/1945 | Switzerland | 416/215 |
| 664,153 | 1/1952 | United Kingdom | 416/213 A |
| 669,745 | 4/1952 | United Kingdom | 416/213 A |

*Primary Examiner*—Everette A. Powell, Jr.
*Attorney, Agent, or Firm*—Charles M. Kaplan

[57] ABSTRACT

A fan wheel in which the blades and hub assembly are fabricated from pieces of plate welded together along extended surfaces.

5 Claims, 3 Drawing Figures fig.1.
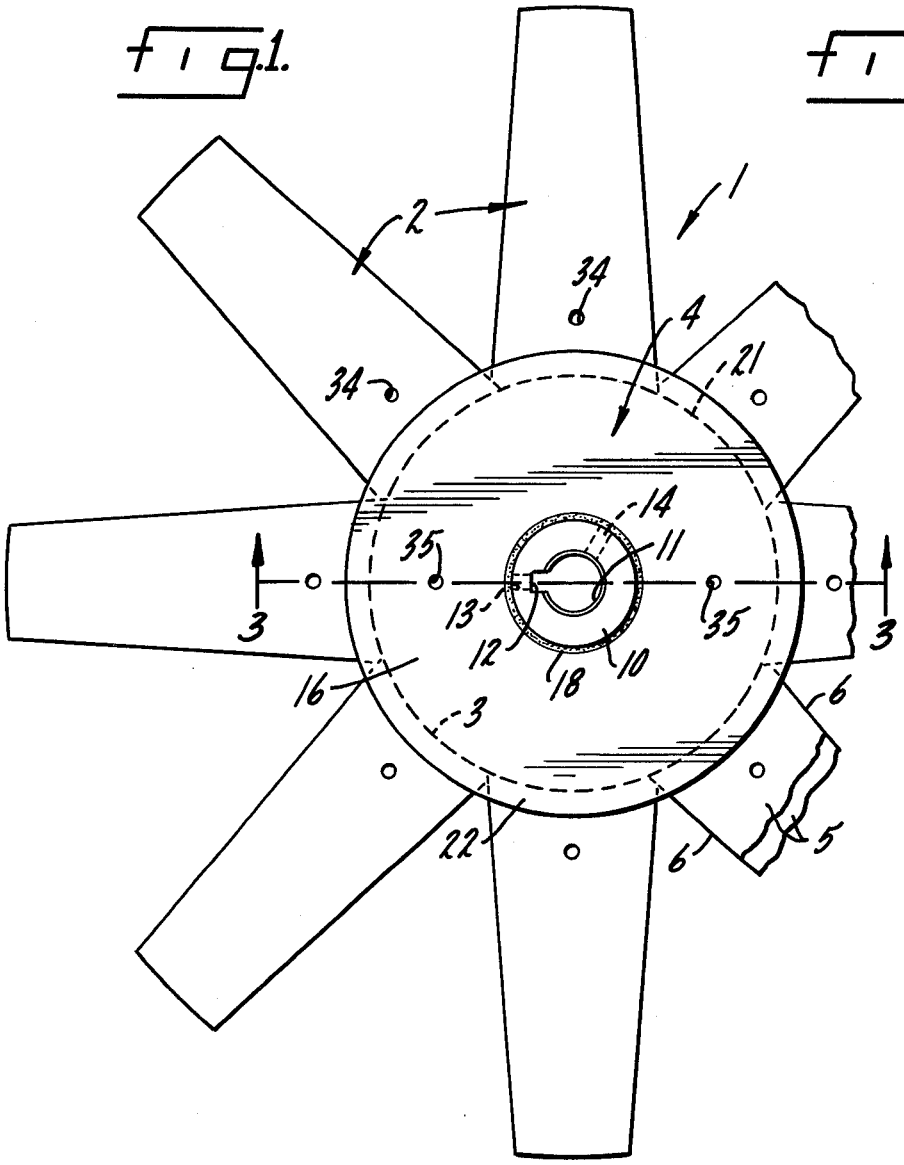
fig.2.
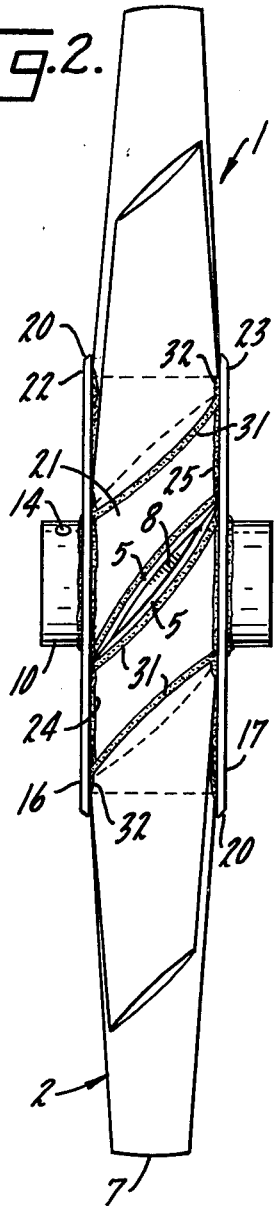
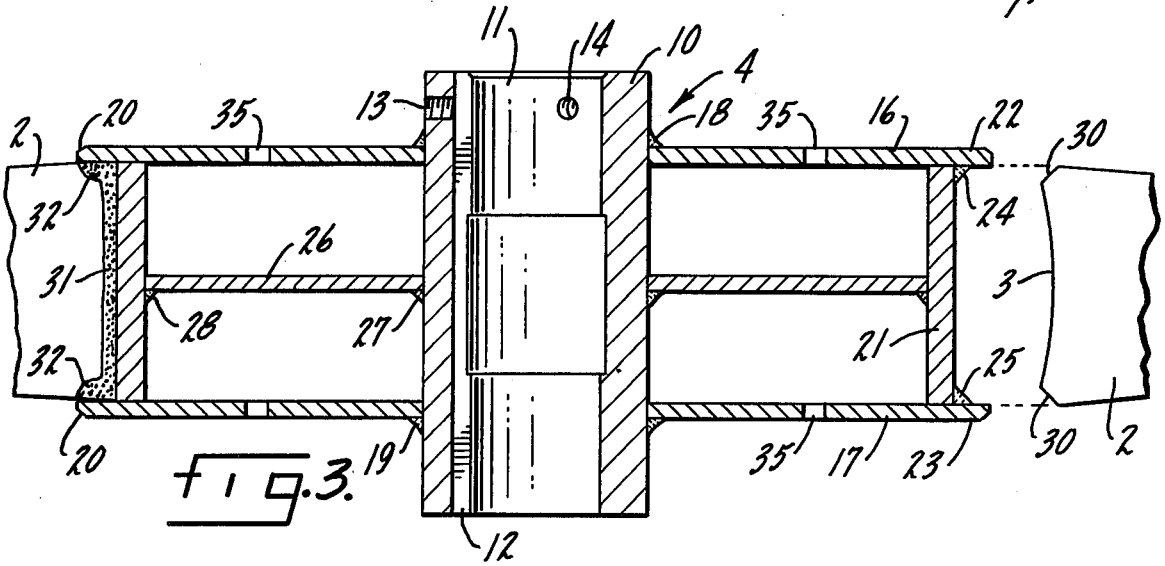
fig.3.

FAN WHEEL

BACKGROUND OF THE INVENTION

My invention relates to fans, and more particularly to heavy duty gas blower fan wheels.

Fan wheels used in rugged service applications, such as high temperature blowers of heat treating furnaces, constructed according to the prior art have not been entirely satisfactory. Some of such fans were made from numerous pieces having different or complicated sizes and shapes, or else required relatively expensive machinery or fabrication techniques to assemble and join the pieces from which they were made. Other prior art fans have not been sufficiently durable.

SUMMARY OF THE INVENTION

Accordingly, it is an object of my invention to provide a fan that is constructed from a minimum number of differently shaped parts.

Another object is to provide an improved gas blower fan wheel for use at high temperatures.

Another object is to provide a fan wheel in which the parts are joined by relatively long weldments.

Another object is to provide a heavy duty fan wheel that is hollow and relatively light weight.

Another object is to provide a reversible, axial flow fan wheel that is strong, durable, relatively low-cost, and which does not possess defects found in corresponding prior art devices.

Briefly stated, according to one aspect of my invention, a fan wheel hub assembly includes a pair of axially spaced discs that define flanges to which fan blades are joined by weldments of increased length.

DESCRIPTION OF THE DRAWINGS

FIG. 1 is a partially broken-away, end view of a preferred embodiment of the invention.

FIG. 2 is a side view of the invention shown in FIG. 1.

FIG. 3 is an enlarged, partially disassembled view taken along the line 3—3 in FIG. 1.

DESCRIPTION OF A PREFERRED EMBODIMENT

FIGS. 1 and 2 show a reversible, axial flow fan wheel 1 in accord with my teachings suitable for use as the gas blower of a heat treating furnace at elevated temperatures up to at least 1750° F. Typically, such a fan wheel would have a diameter of at least sixty-six inches and weigh five hundred pounds or more. My fan wheel should be made from easily weldable steel or stainless steel plate having a thickness in the range of one-eighth to one-quarter inch.

A plurality of identical, symmetrical blades 2 are welded at their radially inner ends 3 to a hub assembly 4. Each blade is made from a pair of identical, curved, tapered, plate members 5, which are placed in face-to-face abutment and welded together along their touching edges at 6. Thus, each blade 2 is a relatively light weight, strong, hollow, open-ended body. Preferably, the terminal end 7 of each blade 2 is sealed by a weldment 8. The inner end 3 of each blade 2 is left open and provides a weldable surface along the inner edge of each plate member 5.

Hub assembly 4 has a hub member 10 with a central opening 11 at its axis of rotation for receiving a power driven rotatable shaft (not shown). Key way 12 and set screws 13 and 14 are used to attach the hub assembly 4 to such a shaft. A pair of discs 16 and 17 each has a center opening receiving the hub member 10. The discs 16 and 17 are axially spaced along the hub member 10, and the outer surfaces of the discs 16 and 17 are welded to the member 10 at weldments 18 and 19. The edges of the discs 16 and 17 are chamfered at 20 to promote increased air flow. A cylindrical ring 21 is placed in the axial space between the discs 16 and 17 with the center axis of the ring 21 coinciding with the axis of rotation of the fan wheel 1. The diameter of the ring 21 is less than the diameter of the discs 16 and 17 so that the terminal edges or circumferential portions the discs 16 and 17 extending radially beyond the ring define radially protruding flanges 22 and 23. The ring 21 and the discs 16 and 17 are attached together by continuous circumferential weldments 24 and 25 which extend into the space at the radially inner ends of the flanges 22 and 23. A centroidal stiffener disc 26 has a center opening receiving the hub member 10. The disc 26 is welded to the member 10 and the ring 21 equidistant between the discs 16 and 17, the weldments being indicated as 27 and 28 in FIG. 3. The disc 26 reduces flexure and torsion of the hub assembly, and also reduces or prevents the tendency of the ring 21 to expand circumferentially during rotation of the fan wheel 1.

At the inner end 3 of each blade 2, the corners are crimped off sufficiently at 30 to provide clearance for the weldments 24 and 25. The end 3 of each blade 2 is placed between the discs 16 and 17 and the blade is oriented to a pre-selected angle with respect to the axis of rotation (e.g. 60′ in FIG. 2). End 3 is shaped so that it fits against ring 21 along substantially its entire conforming surface when oriented at the pre-selected angle, and the front and back edges of each blade 2 are only slightly spaced from the inner surfaces of the flanges 22 and 23. The blades 2 are welded to the ring 21 along the entire surface of each member 5 at inner ends 3, the weldments being identified as 31 herein. Each blade 2 is also welded to the weldments 24 and 25, and the flanges 22 and 23 along the surface of both of its members 5 closely adjacent to the weldments 24 and 25 and the flanges 22 and 23, these additional weldments being identified as 32.

The weldments 31 and 32 securely attach the blades 2 to the hub assembly 4 and distribute stress over a relatively large area. The flanges 22 and 23 provide enlarged surfaces to which the blades 2 are welded, and also reinforce and stiffen the ends of the blades 2 in the area of most critical stress. The flanges 22 and 23 permit the hub assembly 4 to be shortened in the axial direction, and thereby permit the fan wheel 1 to fit into a smaller space. This also tends to increase air flow. Since the fan wheel 1 is completely symmetrical, it can be rotated in either direction.

Breather holes 34 in the blades 2 and breather holes 35 in the discs 16 and 17 vent the interior of the blades 2 and the hub assembly 4 to the atmosphere. This permits equalization of the temperature and pressure at all locations in the fan wheel 1, which is necessary when the fan wheel is used in high or low temperature or pressure environments.

It has thus been shown that by the practice of my invention, a rugged hollow fan wheel can be made from a small number of plate metal parts that can be easily welded together without the necessity for expensive machines or complicated jigs. The blades are reinforced and securely fastened by elongated weldments in the areas of critical stress.

Although my invention has been described with reference to a particular embodiment, I did not intend to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of my invention.

I claim:

1. An axial flow fan wheel comprising a hub having an opening for receiving a rotatable shaft and means for attaching said hub to such shaft, a pair of axially spaced discs each having a center opening receiving said hub and being welded to said hub around said center opening, a cylindrical ring in the axial space between said discs being welded at each of its edges to one of said discs radially inwardly from the terminal edges of said discs so as to define with said terminal edges of said discs a pair of flanges which protrude radially beyond said ring, a plurality of fan blades extending radially from said ring, each blade having its inner edge contacting and generally conforming in shape to the outer surface of said ring, said inner edge being welded to said ring, and each blade also being welded to each of said flanges along its front and back edges extending radially outwardly from said inner edge.

2. The invention defined in claim 1 wherein a stiffener disc located at equal distances between said axial discs has its radially inner edge welded to said hub and its radially outer edge welded to the inner surface of said ring.

3. The invention defined in claim 1 wherein circumferential weldments connect said ring to said discs so as to occupy space at the radially inner ends of said flanges, and each blade has its corners crimped at said inner end to provide clearance for said weldments.

4. The invention defined in claim 1 wherein breather holes in said discs vent the interior of said wheel to the atmosphere.

5. A reversible, axial flow fan wheel comprising a plurality of fan blades and a hub having an opening for receiving a rotatable shaft, means for attaching said hub to such shaft, a pair of axially spaced discs each having a center opening receiving said hub and being welded to said hub around said center opening, breather holes in said discs venting the interior of said wheel to the atmosphere, and said discs being champhered around their peripheral edges, a cylindrical ring in the axial space between said discs being welded at each of its edges to one of said discs radially inwardly from the terminal edges of said discs so as to define with said terminal edges of said discs a pair of flanges which protrude radially beyond said ring, a stiffener disc located at equal distances between said axial discs having its radially inner edge welded to said hub and its radially outer edge welded to the inner surface of said ring, said fan blades extending radially from said ring, and each blade comprising a pair of identical, curved, tapered plate members welded to each other along corresponding edges so as to form a symmetrical, hollow, open-ended blade, the radially outer-most edges of said plate members being connected by a weldment that seals each blade at its terminal end, and a breather hole venting the hollow interior of each blade to the atmosphere, each blade having its inner edge contacting and generally conforming in shape to the outer surface of said ring, said inner edge being welded to said ring, each blade also being welded to each of said flanges along its front and back edges extending radially outwardly from said inner edge, and circumferential weldments connecting said ring to said discs so as to occupy space at the radiallly inner ends of said flanges, and each blade having its corners crimped at said inner end to provide clearance for said weldments.

* * * * *